US005826759A

United States Patent [19]

Ohsugi

[11] Patent Number: 5,826,759

[45] Date of Patent: Oct. 27, 1998

[54] HANGER

[75] Inventor: Yasuhiro Ohsugi, Hiroshima, Japan

[73] Assignee: NKG Co., Ltd., Hiroshima, Japan

[21] Appl. No.: 812,408

[22] Filed: Mar. 5, 1997

[30] Foreign Application Priority Data

Mar. 6, 1996 [JP] Japan ..... 8-049342
Jul. 17, 1996 [JP] Japan ..... 8-187860

[51] Int. Cl.[6] ..... A47G 25/42; A47G 25/40; A47G 25/46; A47G 25/14

[52] U.S. Cl. ..... 223/85; 223/89; 223/94

[58] Field of Search ..... 223/85, 94, 89, 223/DIG. 4, 92

[56] References Cited

U.S. PATENT DOCUMENTS 1,769,076 7/1930 Shrack ..... 223/94
2,621,834 12/1952 Irving ..... 223/89
2,728,499 12/1955 Mueller ..... 223/94
2,775,379 12/1956 Gordon .
4,823,444 4/1989 Larsen ..... 223/DIG. 4
5,007,562 4/1991 Brink et al. ..... 223/94
5,579,964 12/1996 Fochtman ..... 223/94

FOREIGN PATENT DOCUMENTS 2 257 353 1/1993 United Kingdom .

*Primary Examiner*—Bibhu Mohanty
*Attorney, Agent, or Firm*—Darby & Darby

[57] ABSTRACT

The invention provides a hanger including two loops for suspending a garment. The length of an extension, extending from an end of each loop, projecting from a supporting part for supporting the extension is adjustable, so that the cross-wise dimension of loops corresponding to the breadth of the shoulder of a garment can accord with the size of the garment.

15 Claims, 18 Drawing Sheets

HANGER

BACKGROUND OF THE INVENTION

1. Field of the Invention

The present invention relates to a hanger for hanging a garment for storage, and more particularly, it relates to a hanger applicable to a children's garment.

2. Description of Related Art

When a children's garment is suspended on a general size hanger, it can take a long time or the shape of the garment can be spoiled because the latitudinal length of the hanger is too large for the children's garment. In view of such a problem, a hanger exclusively for a children's garment is commercially available.

However, a children's garment can be in a variety of sizes, and a purchased hanger for a children's garment may not suit the size of a garment to be hung. In addition, when there are two or more children in a family, hangers with plural children's sizes are required. Moreover, it is disadvantageously necessary to purchase a new hanger with a suitable size in accordance with the growth of a child.

BRIEF SUMMARY OF THE INVENTION

The present invention was devised in view of the aforementioned problems, and the object is providing a hanger which has loops with a dimension adjustable with the size of a garment to be hung and which can be hung on a high position even by a child because a distance between the loops and a suspending part is elongated by decreasing the dimension of the loops.

The hanger of this invention comprises two loops, each made from a flexible material, for suspending an object to be hung; a supporting part for movably supporting loop extensions made from the flexible material and extended from the loops between the two loops; and a suspending part linked with one end of each of the loop extensions projected from the supporting part, wherein a dimension of the loops is adjustable by moving the loop extensions in accordance with a distance between the supporting part and the suspending part.

Accordingly, in the present hanger, when the suspending part linked with the one ends of the loop extensions is moved away from the supporting part, the dimension of the loops is decreased. When the dimension of the loops is decreased, the crosswise length of the shoulders of the hanger for suspending the object is decreased. Thus, the dimension of the shoulders of the hanger can be adjusted in accordance with the size of the object to be hung. Furthermore, since the object to be hung is suspended on the loops, the object can be stably supported even when the flexible material is a thin wire because the flexure in the gravitational direction is small.

In one aspect of the invention, the supporting part includes a first fixing part for fixing one end of the flexible material and a presser part for locking movement of the loop extensions by applying a pressure to the loop extensions, and the suspending part includes a second fixing part for fixing the other end of the flexible material.

Accordingly in such a case, when the loop extensions are pressed by the presser part, the loop extensions become unmovable, resulting in fixing the dimension of the loops. Therefore, the dimension of the loops cannot be decreased owing to the weight of the object to be hung during the usage of the hanger.

In still another aspect of the invention, the supporting part includes a case separable in the back-and-forth direction for housing the loop extensions and a screw member for fixing the case, and the loop extensions are pressed through the case by screwing the screw member.

Accordingly in such a case, the loop extensions are pinched by the case for housing the loop extensions and pressed by screwing the screw member, and hence, switching the adjustment and fixation of the dimension of the loops can be easily adjusted and fixed. Furthermore, since the movable parts of the loop extensions are covered with the case, the loop extensions are prevented from coming off from the supporting part during the movement.

In still another aspect of the invention, the two loop extensions cross each other in the supporting part.

Accordingly in such a case, owing to the crossing of the loop extensions, the flexibility in a direction toward the center of each loop is smaller than in the case where the loop extensions do not cross each other, resulting in allowing smooth movement of the loop extensions. Furthermore, when the crossing point of the loop extensions is disposed in the vicinity of the presser part or the screw member, the loop extensions can be pressed without fail.

In still another aspect of the invention, the flexible material is a wire, and each of the loops is provided with a hanger supporting member which has a width larger than a diameter of the wire and a length along the loop, at a portion for supporting the object to be hung.

Accordingly in such a case, the hanger assisting member supports, for example, the shoulders of a garment, and hence, the garment can be stably supported even when the flexible material is a thin wire.

In still another aspect of the invention, the suspending part includes a catching part projecting from a rear face of the suspending part in a reverse L-shape in a sectional view, and the catching part is able to bend in the back-and-forth direction owing to a plurality of hinges provided on a rear face thereof.

Accordingly in such a case, the catching part can bend in the back-and-forth direction, and hence, the hanger can be suspended on a variety of places. Furthermore, when the catching part is bent toward the outside of the collar of a suspended garment, the shape of the collar can be prevented from being spoiled.

In still another aspect of the invention, the suspending part has a plurality of ribs on a face reverse to a face close to the supporting part, and the ribs are aligned in a crosswise direction crossing the back-and-forth direction with a distance substantially equal to a width of the catching part.

In still another aspect of the invention, the suspending part has a plurality of ribs on a rear face aligned in a crosswise direction crossing the back-and-forth direction with a distance substantially equal to a width of the catching part.

Accordingly in such cases, the top face of the suspending part of a first hanger is inserted into a space between the suspending part and the catching part of a second hanger, so that these hangers can be linked with each other. At this point, the base portion, close to the suspending part, of the catching part of the second hanger is fit between the ribs of the first hanger, so that the second hanger can be fixed on and supported by the first hanger. This can stabilize the linkage between the first hanger and the second hanger.

The above and further objects and features of the invention will more fully be apparent from the following detailed description with accompanying drawings.

DETAILED DESCRIPTION OF THE INVENTION

The present invention will now be described in detail with reference to the accompanying drawings illustrating the embodiments thereof.

Figure 1:
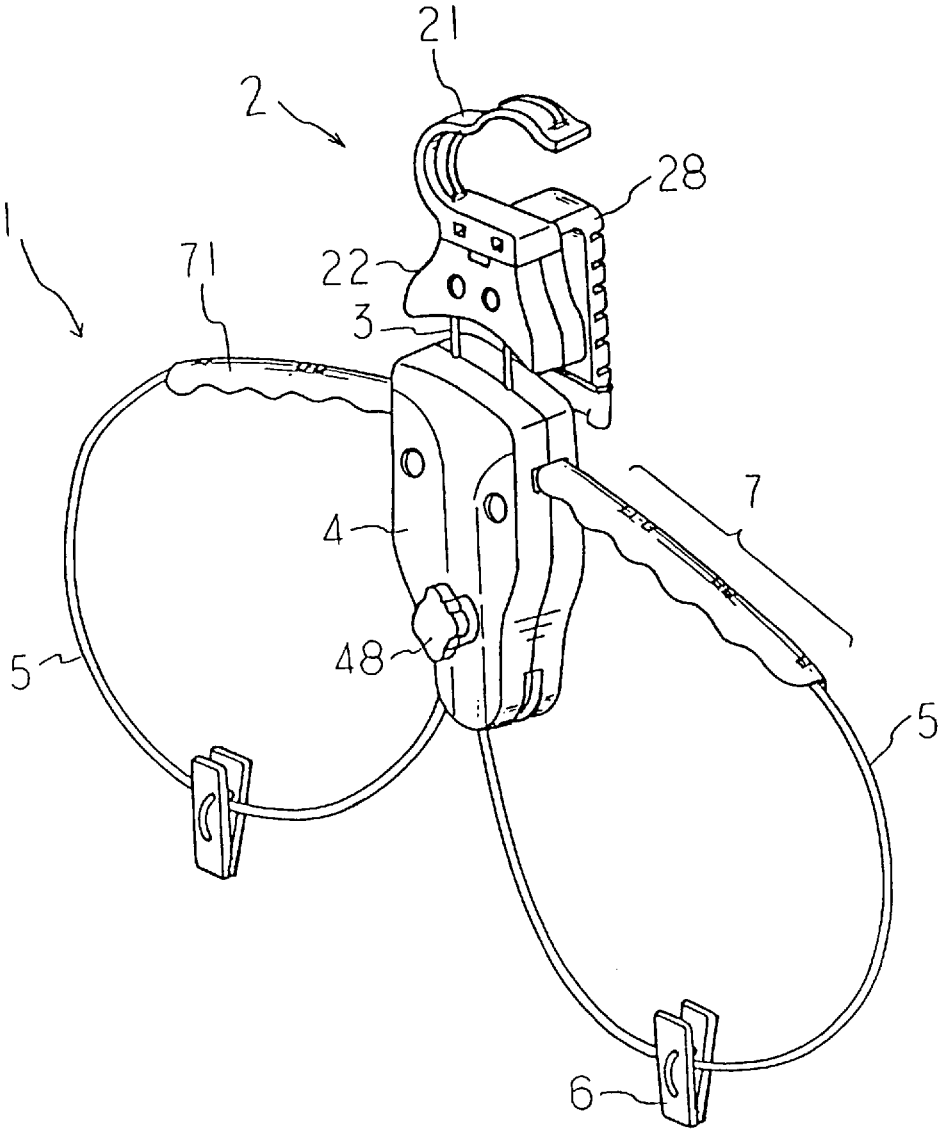
FIG. 1 is a perspective view for showing the structure of a hanger according to a first embodiment of the invention.
Figure 2:
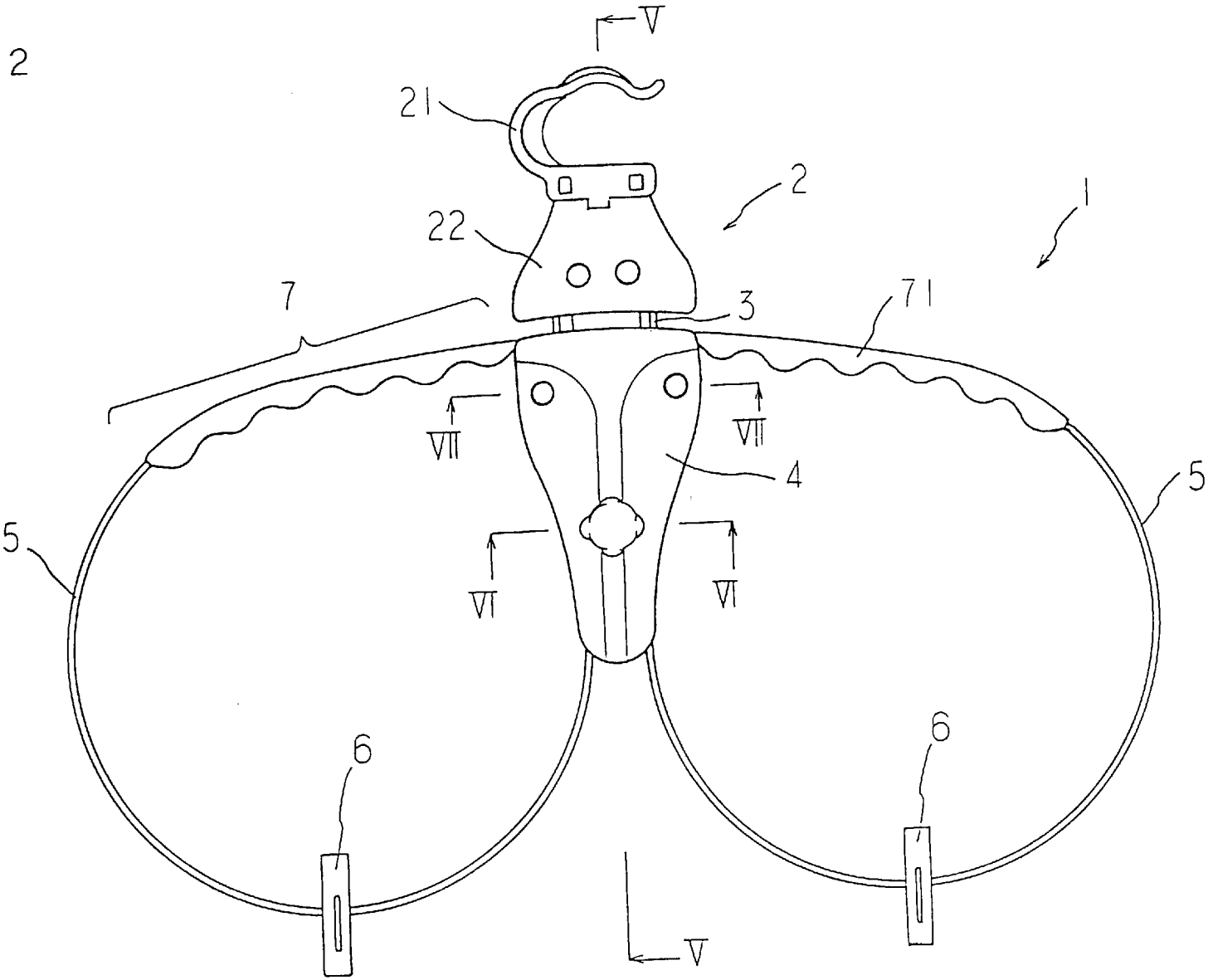
FIG. 2 is a front view of the hanger of FIG. 1.
Figure 3:
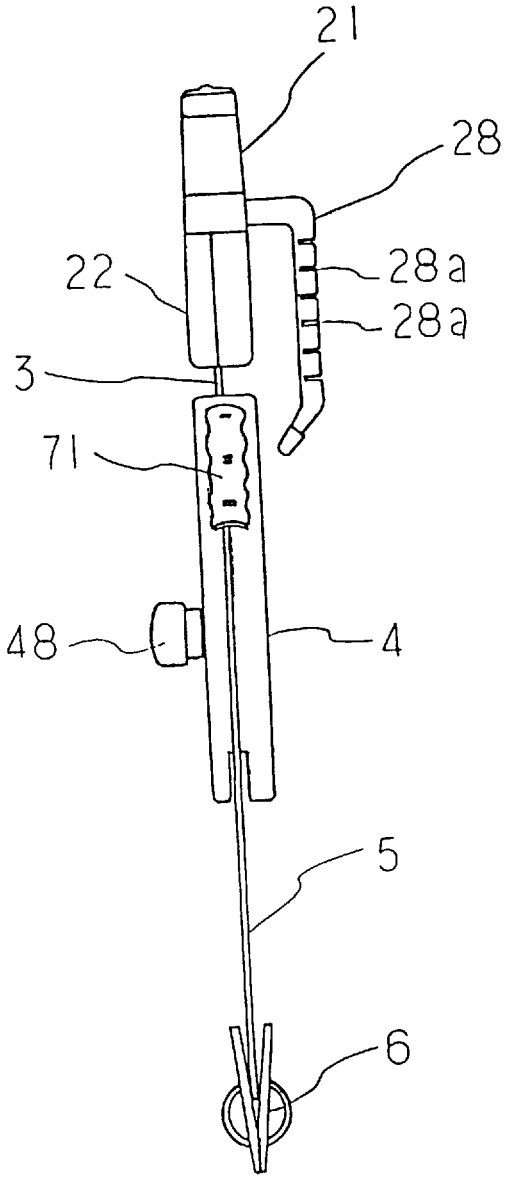
FIG. 3 is a right side view of the hanger of FIG. 1.
Figure 4:
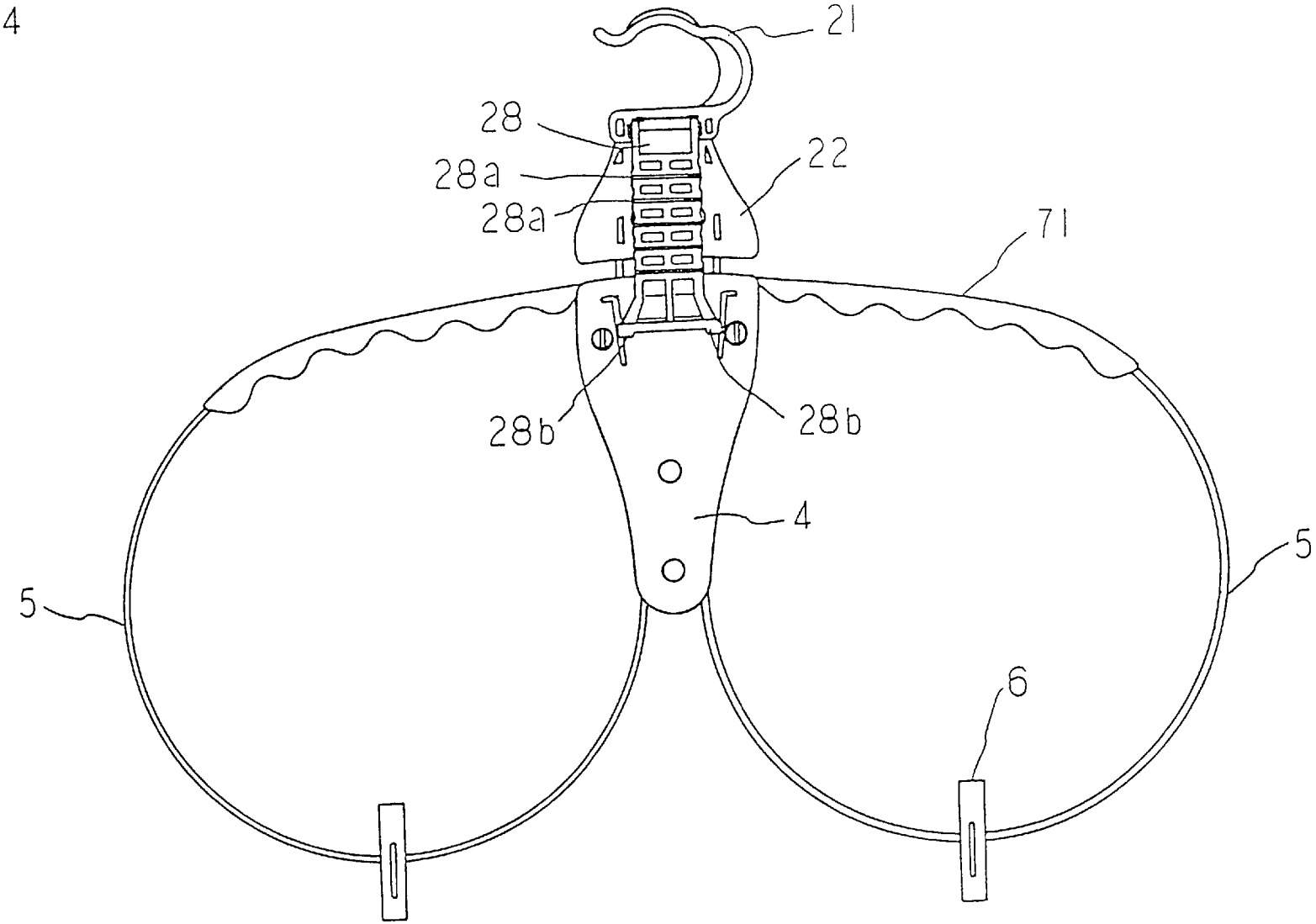
FIG. 4 is a rear side view of the hanger of FIG. 1.
Figure 5:
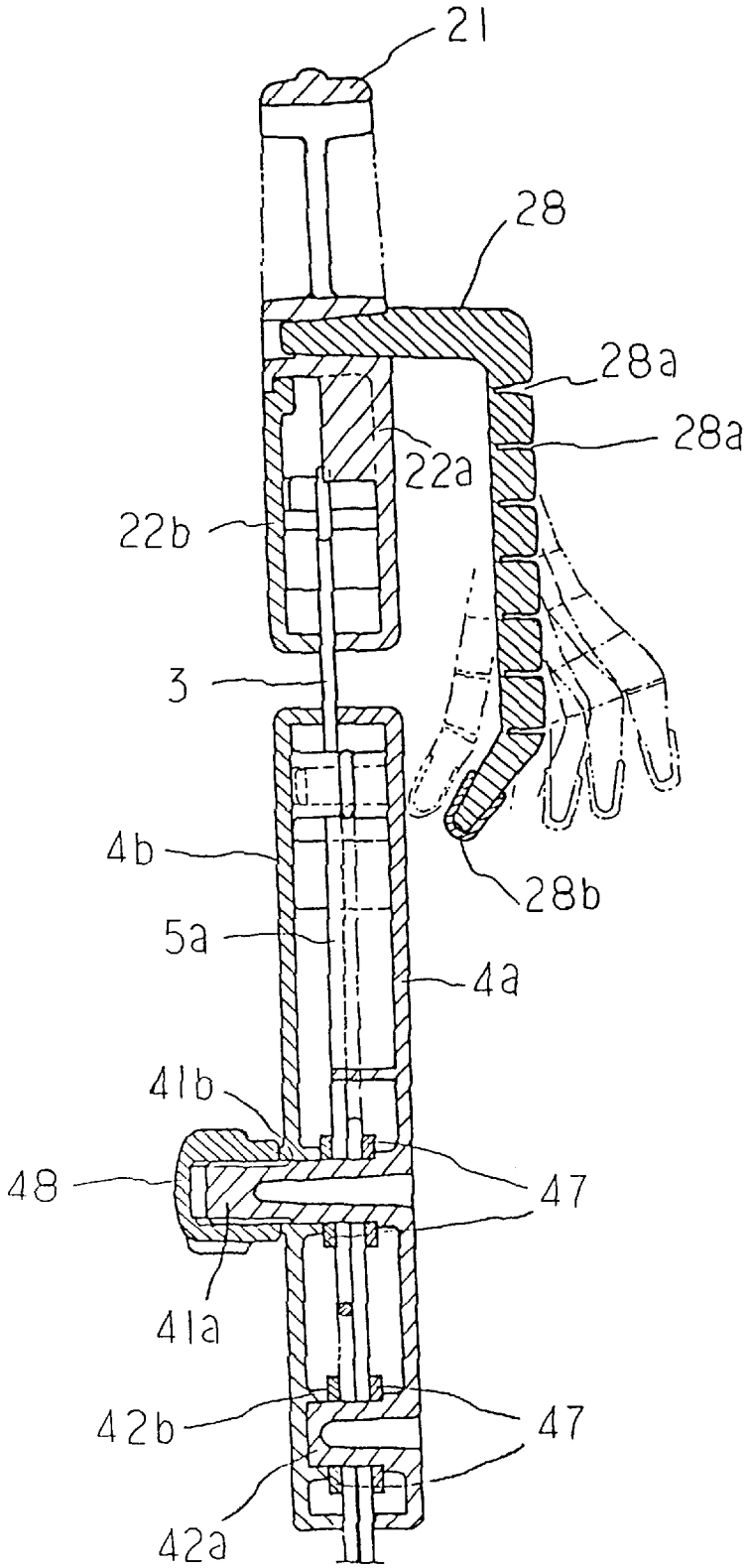
FIG. 5 is a sectional view taken on line V—V of FIG. 2.
Figure 6:
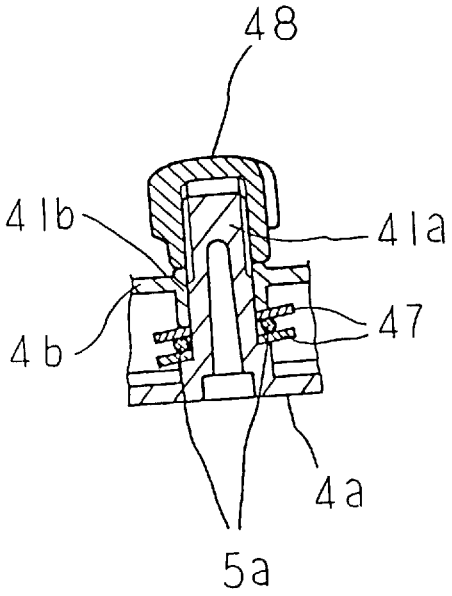
FIG. 6 is a sectional view taken on line VI—VI of FIG. 2.
Figure 7:
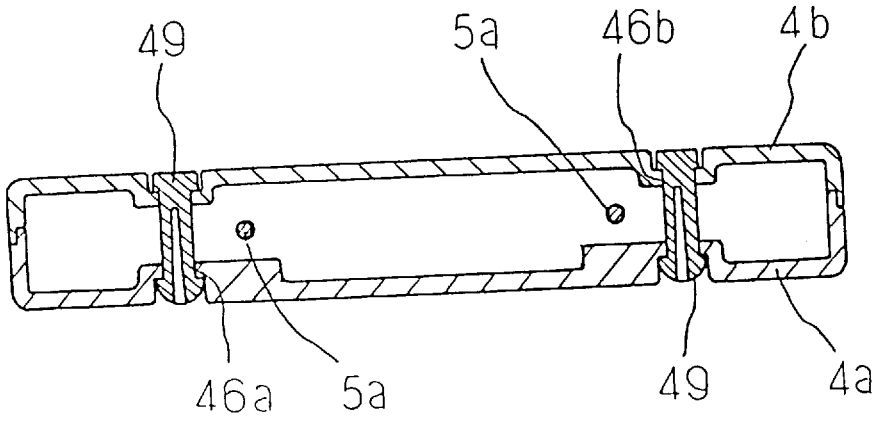
FIG. 7 is a sectional view taken on line VII—VII of FIG. 2.
Figure 8:
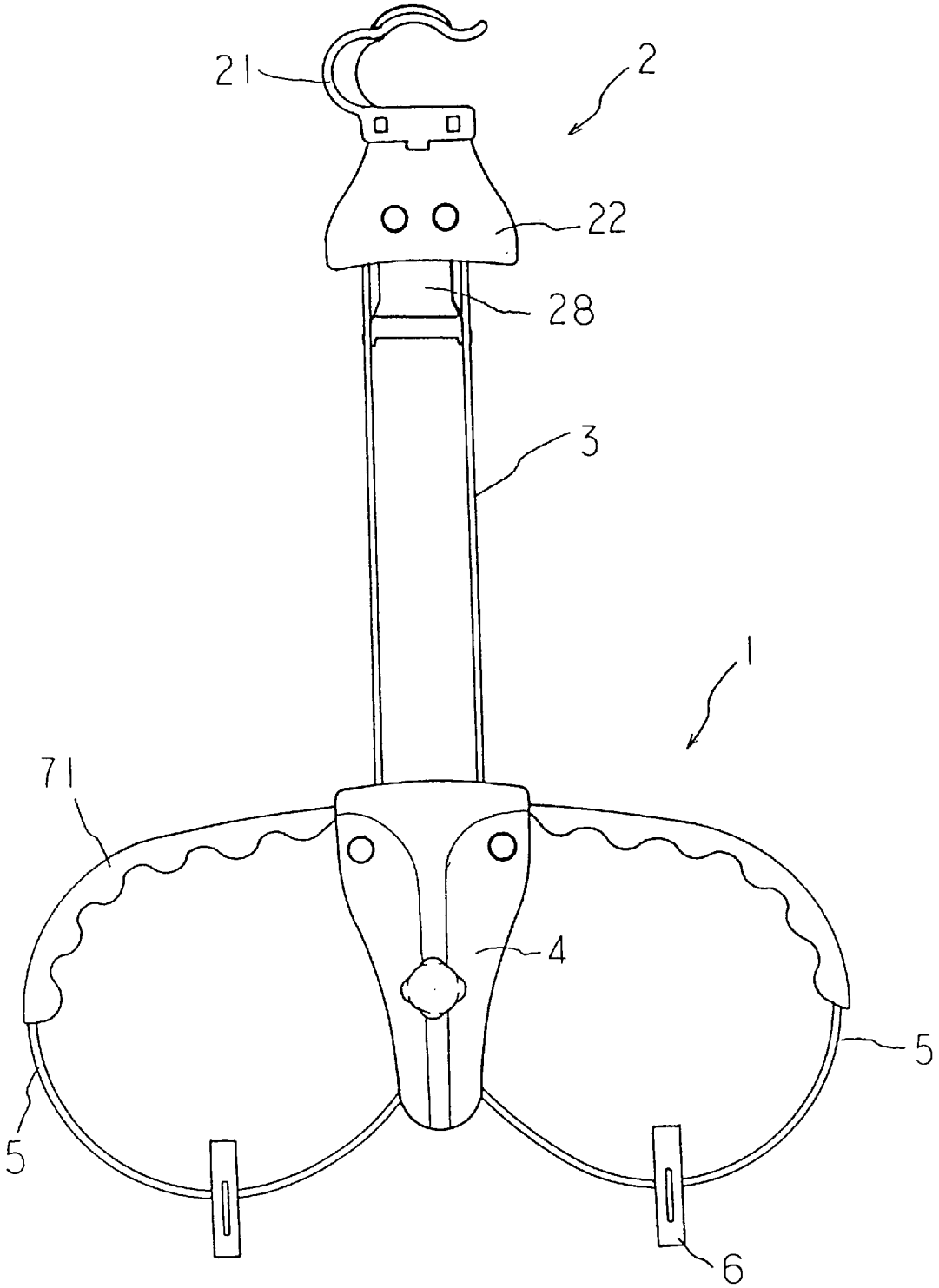
FIG. 8 is a front view of the hanger of FIG. 1 with the crosswise length of a hanging member narrowed.

FIG. 1 is a perspective view for showing the structure of a hanger of the first embodiment, and FIGS. 2, 3 and 4 are a front view, a right side view and a rear side view thereof, respectively. FIG. 5 is a sectional view taken on line V—V of FIG. 2, FIG. 6 is a sectional view taken on line VI—VI of FIG. 2, and FIG. 7 is a sectional view taken on line VII—VII of FIG. 2. As is shown in these drawings, the hanger of this embodiment comprises a hanging member 1 and a suspending member 2 linked with each other through a neck part 3. The hanging member 1 includes two loops 5 aligned in the latitudinal direction and a supporting case 4 for supporting loop extensions 5*a* extending from the loops 5. On the upper portions of the loops 5, the neck and shoulders of a garment are suspended. A skirt, slacks and the like can be clipped with clipping members 6, which are movable along the loops 5. The hanger is suspended by hanging the suspending member 2 on, for example, a bar in a wardrobe or a lintel. In this hanger, when the suspending member 2 is moved away from the supporting case 4, the neck part 3 is elongated, so that the loops 5 are shortened to narrow the latitudinal length of the hanging member 1. FIG. 8 is a front view of the hanger with the latitudinal length of the hanging member 1 narrowed.

Now, the structure of the hanging member 1 will be described.

Figure 9:
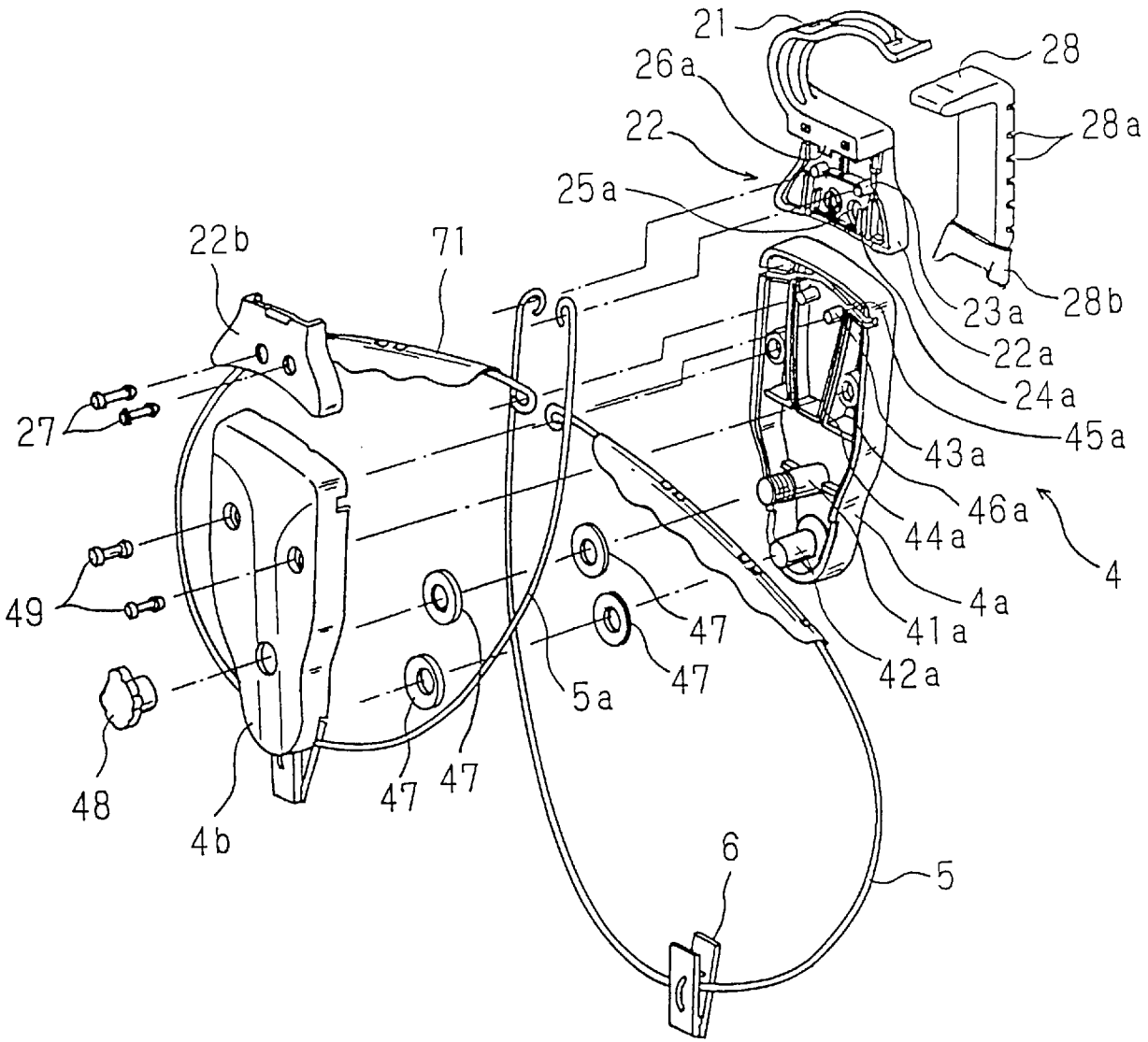
FIG. 9 is an exploded perspective view of the hanger of FIG. 1.
Figure 10:
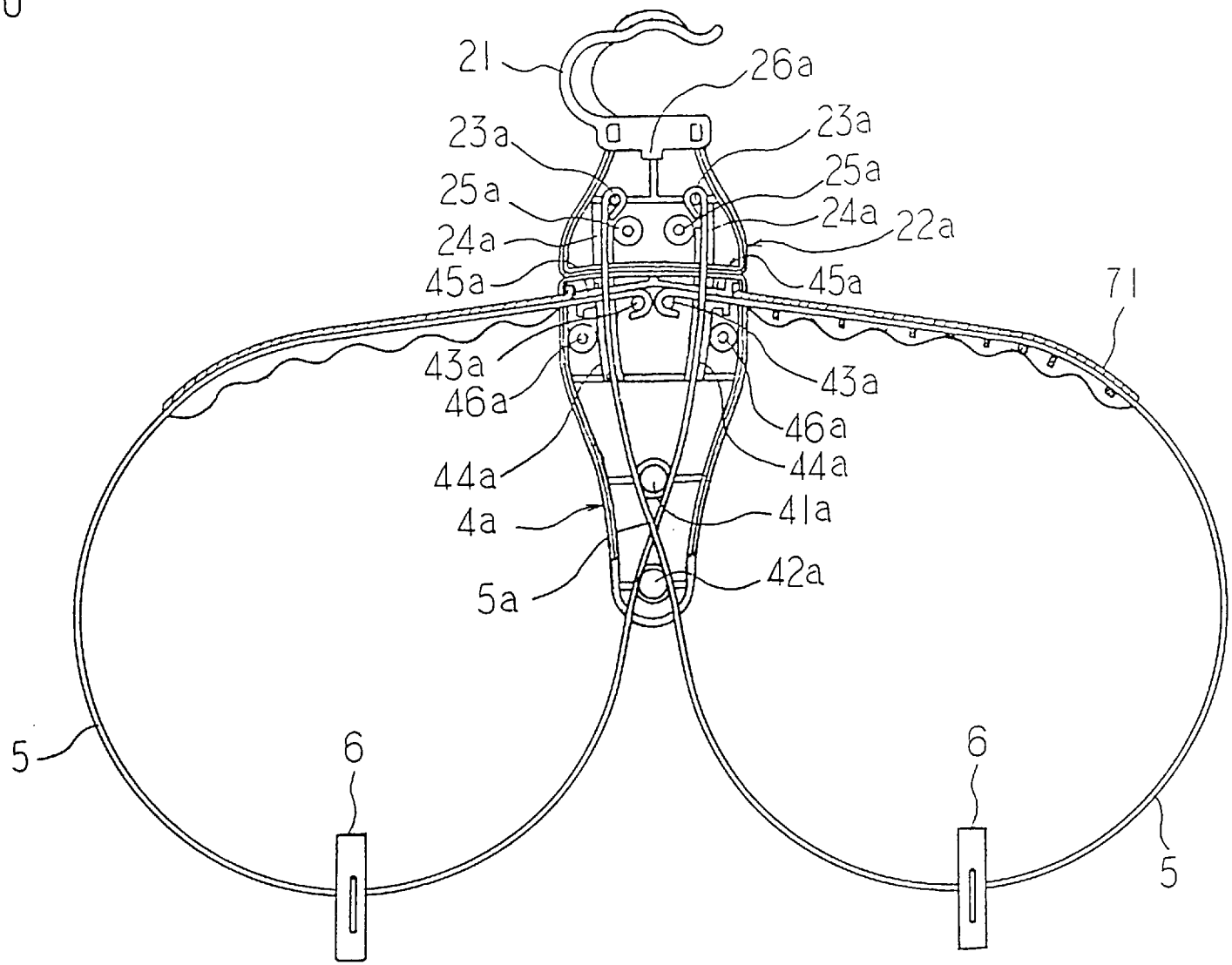
FIG. 10 is a front view of the hanger of FIG. 1 from which a supporting case cover and a fixing case cover are removed.

FIG. 9 is an exploded perspective view of the hanger of this embodiment, and FIG. 10 is a front view thereof from which a supporting case cover 4*b* and a fixing case cover 22*b* described below are removed. The supporting case 4 for supporting the loops 5 is made of a synthetic resin such as PPF (polypropylene resin including fiber), and is in a shape, in a front view, having a square upper portion and a narrower and rounded lower portion. As is shown in FIG. 9, the supporting case 4 includes a supporting case body 4*a* having an elevated outer-periphery fit with a supporting case cover 4*b* having substantially the same shape as the supporting case body 4*a*. The supporting case body 4*a* has a rod-like fastening projection 41*a* at a substantially center thereof, and the fastening projection 41*a* is threaded from its tip to a predetermined position. A first positioning projection 42*a* is disposed and projected below the fastening projection 41*a*, and second positioning projections 43*a* are aligned and projected in the latitudinal direction in positions near the center of the supporting case body 4*a* and above the fastening projection 41*a*. On the outer sides of the second positioning projections 43*a*, longitudinally extending guide grooves 44*a* for fitting the loop extensions 5*a* are formed to extend from a substantially center of the supporting case body 4*a* to the upper edge thereof. Latitudinally extending guide grooves 45*a* are formed so as to cross the guide grooves 44*a* and respectively extend from points close to the second positioning projections 43*a* to the right and left edges of the supporting case body 4*a*. The latitudinally extending guide grooves 45*a* have a larger depth than the longitudinally extending guide grooves 44*a*, so that the loop extensions 5*a* can be stably fit in the guide grooves 44*a* at crossing points of the guide grooves 44*a* and 45*a*. Furthermore, on the outer sides of the longitudinally extending guide grooves 44*a*, through holes 46*a* are formed.

Figure 11:
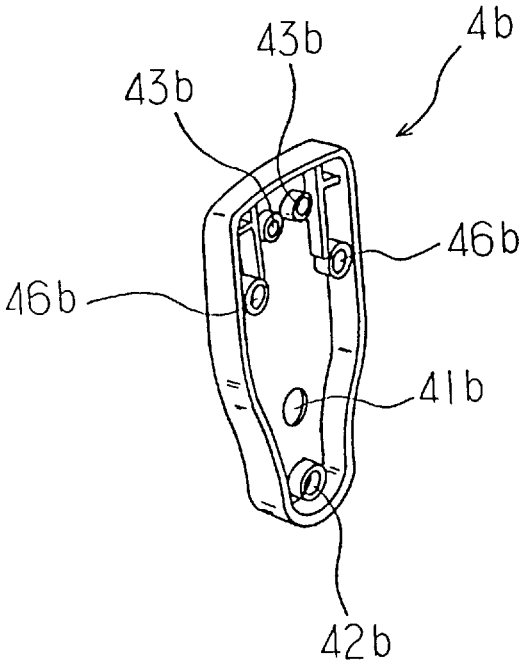
FIG. 11 is a perspective view for showing the rear side structure of the supporting case cover of the hanger of FIG. 1.

FIG. 11 is a perspective view for showing the rear side structure of the supporting case cover 4*b*. The supporting case cover 4*b* has a through hole 41*b* having a slightly larger diameter than the fastening projection 41*a* in a position corresponding to the fastening projection 41*a* of the supporting case body 4*a*. In positions corresponding to the first positioning projection 42*a* and the second positioning projections 43*a*, a first positioning hole 42*b* and second positioning holes 43*b* are respectively formed so as to have slightly larger diameters than the corresponding projections. Also, in positions corresponding to the through holes 46*a* of the supporting case body 4*a*, through holes 46*b* having substantially the same diameter as the through holes 46*a* are formed.

A wire used as the loops 5 is preferably made from a material having sufficient strength and appropriate flexibility, and a hard steel wire (SWIC-F) is used in this embodiment. As is shown in FIG. 10, a first wire is wound around the left positioning projection 43*a* at its one end, fit in the left latitudinally extending guide groove 45*a* so as to extend outward from the upper portion of the supporting case 4, so that the left loop 5 can be formed outside of the supporting case 4. Then, after forming the loop 5, the wire is extended from the lower edge of the supporting case 4 to be positioned on the left side of the first positioning projection 42*a* and on the right side of the fastening projection 41*a*, fit in the right longitudinally extending guide groove 44*a*, and projected upward from the upper edge of the supporting case 4, thereby forming the loop extension 5*a*. The other end of the first wire is fixed in the suspending member 2 described below. A second wire is wound around the right positioning projection 43*a* at its one end and extended latitudinally symmetrically to the first wire, and fixed in the suspending member 2 at the other end. The loop extensions 5*a* cross each other at a point between the first positioning projection 42*a* and the fastening projection 41*a*. Either of the wires can be disposed above at the crossing point, and the first wire is disposed above the second wire at the crossing point in this embodiment.

The upper portion of each loop 5 extends from the upper portion of the supporting case 4 in a substantially horizontal direction, and is provided with a shoulder assisting member 71 of elastomer, thereby forming a shoulder part 7. The shoulder assisting member 71 has a plurality of hooks for catching the loop 5 on the rear face, and is provided on the loop 5 with its one end contained in the supporting case 4. The shoulder assisting member 71 has a shape and dimension appropriate for supporting the shoulders of a garment and has a suitable friction coefficient, so that the garment can be stably hung thereon. Furthermore, the lower portion of each loop 5 is provided with the clipping member 6 for clipping and suspending a skirt or the like, so as to be movable along the loop 5. When the loop 5 is changed in its size, the clipping member 6 can be always positioned at the lower portion of the loop 5.

In assembling the hanging member 1 having the aforementioned structure, the wires are disposed as described above, the positioning projections 42*a* and 43*a* of the supporting case 4 are respectively fit in the corresponding positioning holes 42*b* and 43*b* as is shown in FIGS. 9 and 11, and the fastening projection 41*a* is fit in the through hole 41*b*, thereby setting the supporting case cover 4*b* on the supporting case body 4*a*. At this point, collars 47 are interposed between the fastening projection 41*a* and the through hole 41*b* and between the first positioning projection 42*a* and the positioning hole 42*b* so as to sandwich the loop extensions 5*a*. Then, a cap nut 48 is screwed on the fastening projection 41*a* projected through the through hole 41*b*, and latch pins 49 are inserted into the through holes 46*a* and 46*b*. Thus, the supporting case cover 4*b* is fixed on the supporting case body 4*a*. By screwing the cap nut 48, the supporting case cover 4*b* presses the collars 47, so that the loop extensions 5*a* around the fastening projection 41*a* are pressed by the collars 47 to be unmovably locked. When the cap nut 48 is loosened, the loop extensions 5*a* become movable. The cap nut 48 has an irregular periphery so as to be easily turned.

Next, the structure of the suspending member 2 will be described. The suspending member 2 includes, as is shown in FIGS. 1 through 8, a clipping part 21 in a U-shape with its opening facing rightward (or leftward) as its upper portion and a fixing case 22 for fixing the ends of the wires as its lower portion. The clipping part 21 is provided with a catching part 28 in a reverse L-shape, in a side view, on its lower rear face. The clipping part 21 and the fixing case 22 are made of a synthetic resin such as PPF, and the catching part 28 is made of a synthetic resin such as polyethylene (PE).

The fixing case 22 is in a substantially trapezoidal shape in a front view, and includes, as is shown in FIG. 9, a fixing case body 22*a* having an elevated outer-periphery fit with a fixing case cover 22*b* having substantially the same shape as the fixing case body 22*a*. The fixing case body 22*a* is integrated with the clipping part 21. The fixing case body 22*a* is provided with rod-like positioning projections 23*a* latitudinally aligned at a substantially center. Below the positioning projections 23*a*, longitudinally extending guide grooves 24*a* for fitting the wires are formed to reach the lower edge of the fixing case body 22*a*. On the inner sides of the guide grooves 24*a*, through holes 25*a* are latitudinally aligned. The upper portion of the fixing case body 22*a*, namely, the lower portion of the clipping part 21, has a larger thickness by a dimension corresponding to the thickness of the fixing case cover 22*b* so that projecting in front. At the center of this thicker portion, an adjusting protrusion 26*a* having a predetermined thickness and extending downward is provided.

Each wire extending upward from the upper edge of the supporting case 4 is, as is shown in FIG. 10, fit in the guide groove 24*a* of the fixing case body 22*a* and wound around the positioning projection 23*a* at the end so as to be fixed. Thus, the hanging member 1 and the suspending member 2 are linked with each other through the wires forming the neck part 3.

Figure 12:
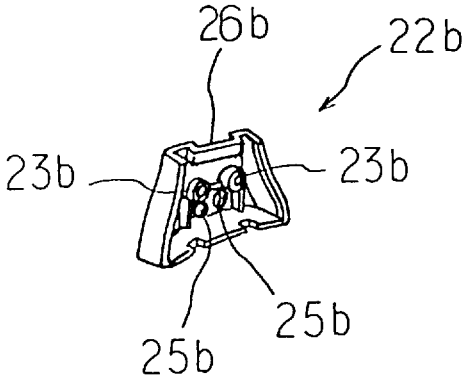
FIG. 12 is a perspective view for showing the rear side structure of the fixing case cover of the hanger of FIG. 1.

FIG. 12 is a perspective view for showing the rear side structure of the fixing case cover 22*b*. The fixing case cover 22*b* has positioning holes 23*b* having a slightly larger diameter than the positioning projections 23*a* of the fixing case body 22*a* in positions corresponding to the positioning projections 23*a*, and also has through holes 25*b* having substantially the same diameter as the through holes 25*a* in positions corresponding to the through holes 25*a*. Furthermore, in a position corresponding to the adjusting protrusion 26*a*, an adjusting recess 26*b* with a depth equal to the height of the adjusting protrusion 26*a* is formed.

In assembling the suspending member 2 having the aforementioned structure, as is shown in FIGS. 9 and 12, the adjusting protrusion 26*a* and the positioning projections 23*a* are fit in the adjusting recess 26*b* and the positioning holes 23*b*, respectively, thereby setting the fixing case cover 22*b* on the fixing case body 22*a*. At this point, the front faces of the fixing case cover 22*b* and the clipping part 21 are positioned at the same level. Then, latch pins 27 are inserted into the through holes 25*a* and 25*b*, thereby fixing the fixing case cover 22*b* on the fixing case body 22*a*.

The catching part 28 disposed on the lower rear face of the clipping part 22 has, as is shown in FIGS. 4 and 5, grooves 28*a* extending latitudinally between the right and left edges of the rear face of the catching part 28 at a predetermined interval in the longitudinal direction. Each of the grooves 28*a* has a depth slightly smaller than the thickness in the back-and-forth direction of the catching part 28, so as to together work as plural hinges. By allowing the side faces of the respective grooves 28*a* to come in contact with or away from one another, the catching part 28 can be bent in the back-and-forth direction within a range shown with two-dot chain lines in FIG. 5. Thus, the catching part 28 can catch various shaped places. Furthermore, the lower portion of the catching part 28 has a larger latitudinal dimension than the upper portion thereof, and is provided with legs 28*b*, which are covered with non-slip caps, at the right and left edges. When the catching part 28 is placed on, for example, a table, the legs 28*b* are in contact with the table, so that the hanger can be stably supported.

Figure 13:
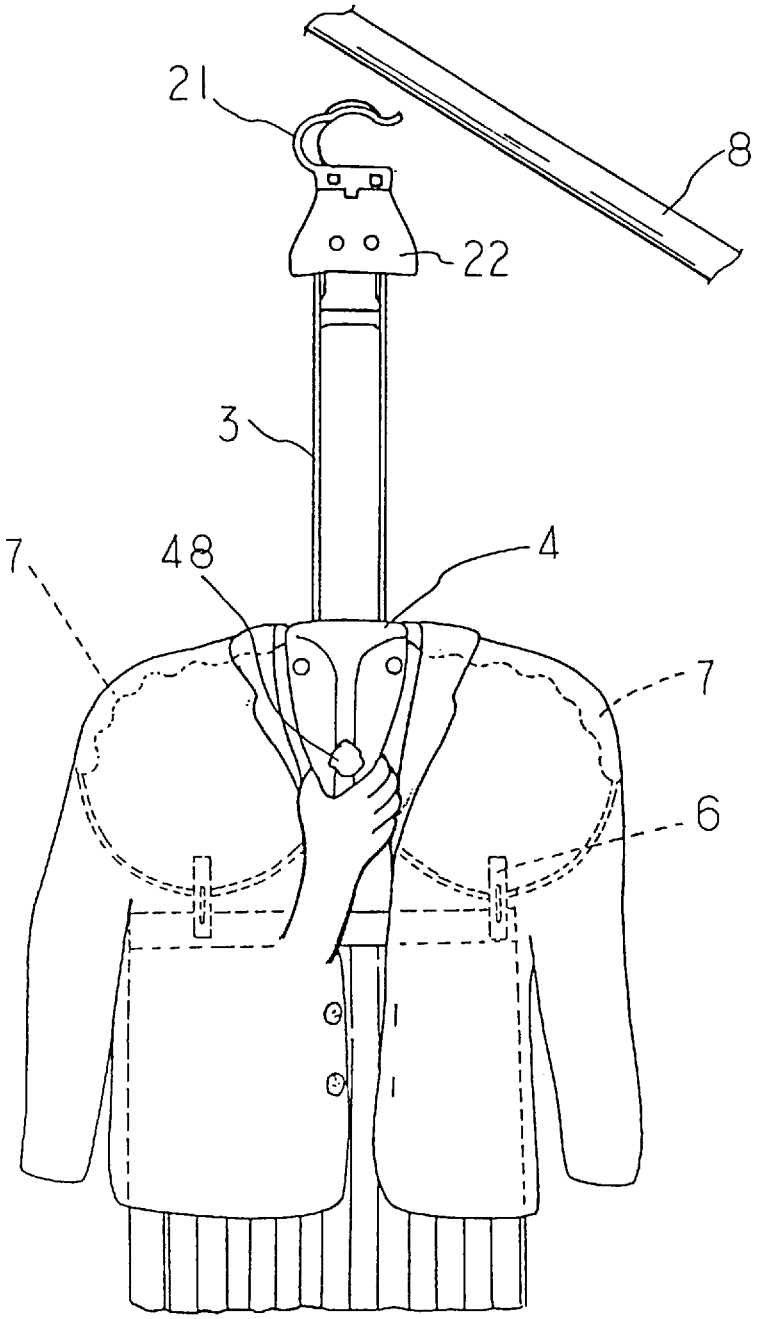
FIG. 13 illustrates usage of the hanger of FIG. 1.

FIG. 13 is a diagram for illustrating usage of the hanger having the aforementioned structure. When a children's garment is to be suspended on the hanger, the cap nut 48 is loosened by turning it in the counterclockwise (or clockwise) direction first, so that the loop extensions 5*a* become movable. Then, the fixing case 22 is moved away from or toward the supporting case 4, so as to elongate or shorten the neck part 3. Thus, the dimension of the loops 5, namely, the latitudinal length of the shoulder parts 7, is adjusted with the size of the children's garment to be hung. When adjusted, the cap nut 48 is turned in the clockwise (or counterclockwise) direction and locked. Under this condition, for example, a children's skirt is suspended by clipping it with the clipping members 6, and a coat is suspended on the shoulder parts 7. Then, with the supporting case 4 gripped with a hand, a bar 8 is clipped with the clipping part 21 so as to suspend the hanger thereon. At this point, the neck part 3 has an increased length by the shortened dimension of the loops, and hence, even a child can suspend the hanger on the bar 8 at a high position.

In this manner, the dimension of the loops 5 can be increased or decreased in the present hanger by adjusting the distance between the fixing case 22 and the supporting case 4, so that the shoulder parts 7 can be adjusted to have a desired latitudinal length. After adjusting the latitudinal length of the shoulder parts 7, the loop extensions 5*a* are pressed and locked by using the cap nut 48, so as to fix the adjusted latitudinal length of the shoulder parts 7. In addition, when a garment to be hung is smaller, the length of the neck part is adjusted to be longer. This is convenient for a child to suspend the hanger on a bar at a high position.

Moreover, in the present hanger, the bottom face of the fixing case 22 has a shape to lie closely on the top face of the supporting case 4. Therefore, when the length of the neck part 3 is minimized, the supporting case 4 and the fixing case 22 are in contact with each other with no gap therebetween. In such a case, the loops 5 have the maximum dimension, and an adult's garment can be suspended on the hanger.

Furthermore, since the catching part 28 has a plurality of hinges on its rear face, it can be bent in the back-and-forth direction. Therefore, the catching part 28 is applicable to a wide range of places, and for example, can catch a grab rail in a car or can hook on the door lintel. Also, the catching part 28 can bent so as not to touch the collar of a hung garment, and hence, the shape of the collar is not spoiled.

Figure 14:
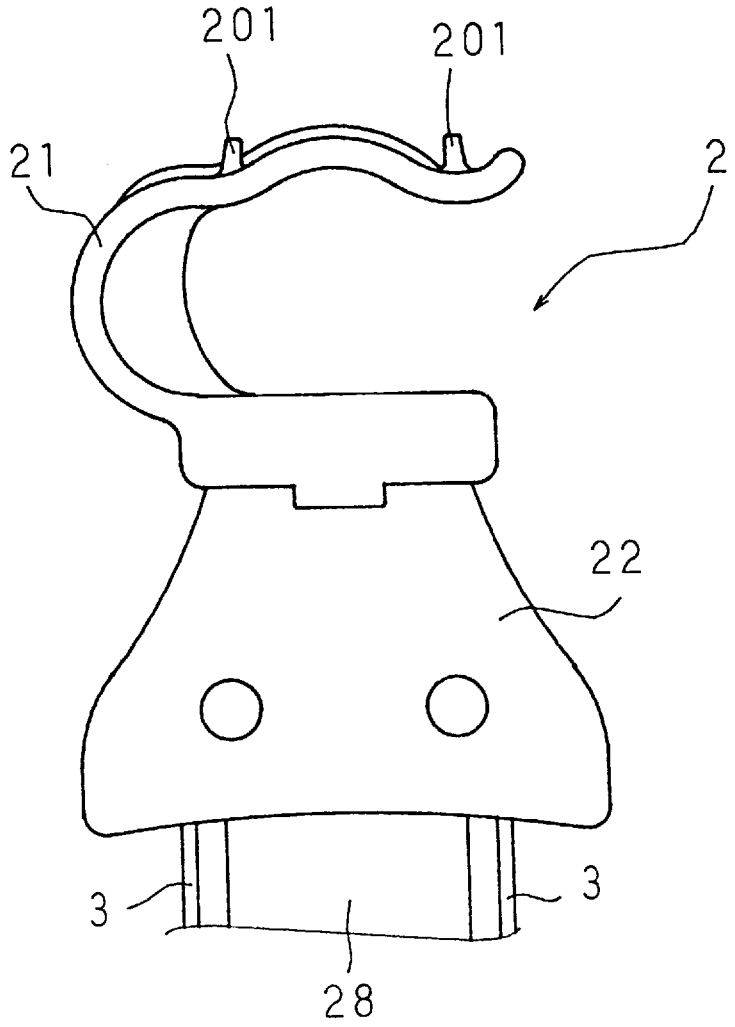
FIG. 14 is a front view for showing the structure of a suspending member of a hanger according to a second embodiment of the invention.
Figure 15:
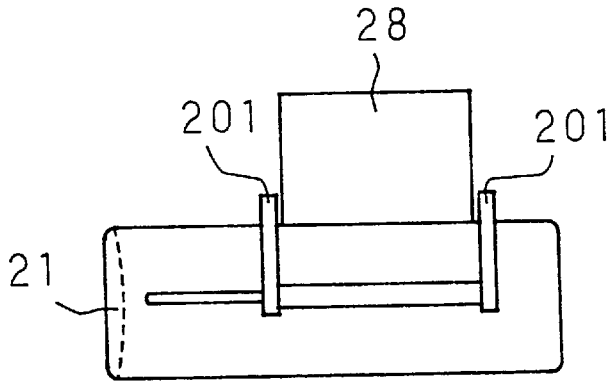
FIG. 15 is a plan view of the suspending member of FIG. 14.
Figure 16:
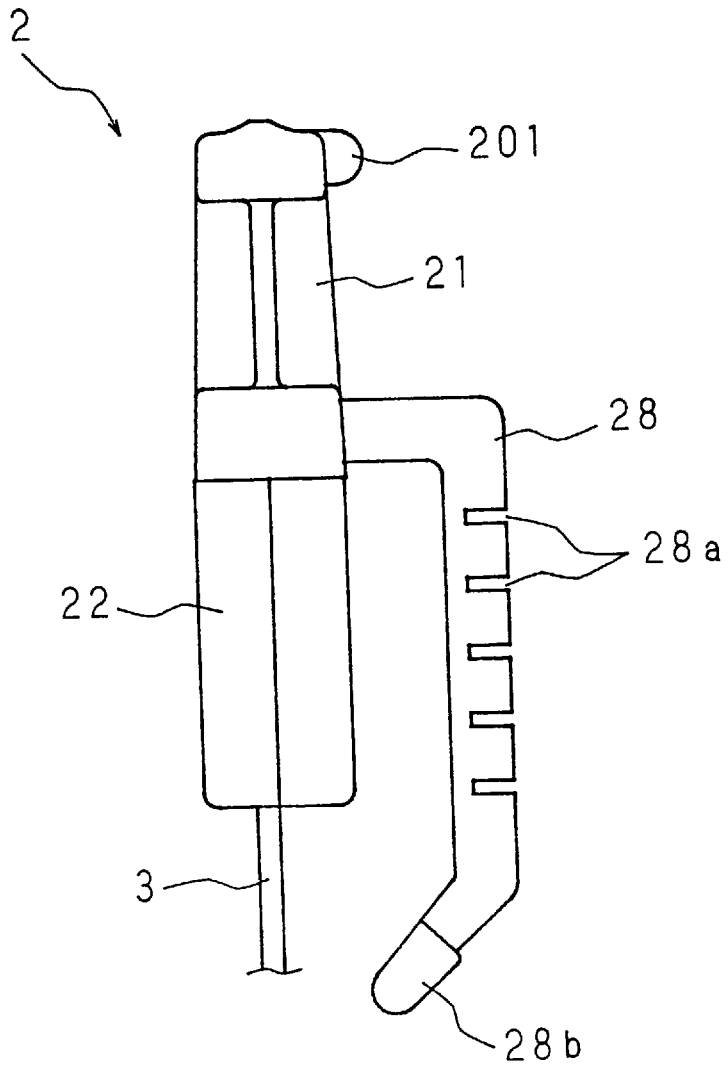
FIG. 16 is a right side view of the suspending member of FIG. 14.

FIG. 14 is a front view for showing the structure of a hanger according to a second embodiment of the invention, wherein portions excluding a suspending member are omitted. FIG. 15 is a plan view of the suspending member of FIG. 14, and FIG. 16 is a right side view of the suspending member of FIG. 14. This suspending member 2 includes a clipping part 21 in a U-shape with its opening facing rightward (or leftward) as its upper portion and a fixing case 22 for fixing the ends of wires as its lower portion. On the lower rear face of the clipping part 21, a catching part 28 in a reverse L-shape in a side view is disposed. The upper face of the clipping part 28 is provided with fixing ribs 201, which characterize this embodiment.

Each fixing rib 201 has a reverse L-shape in a side view, and is formed on the upper face of the clipping part 21 so as to extend toward the rear face thereof and project upward and backward from the clipping part 21. The two fixing ribs 201 are aligned in the latitudinal direction in a front view with a predetermined distance therebetween. The distance between the fixing ribs 201 is substantially the same as and preferably slightly larger than the latitudinal width of the catching part 28. The remaining structure of this hanger is the same as that of the first embodiment, and hence, like reference numerals are used to refer to like elements and description is omitted.

Figure 17:
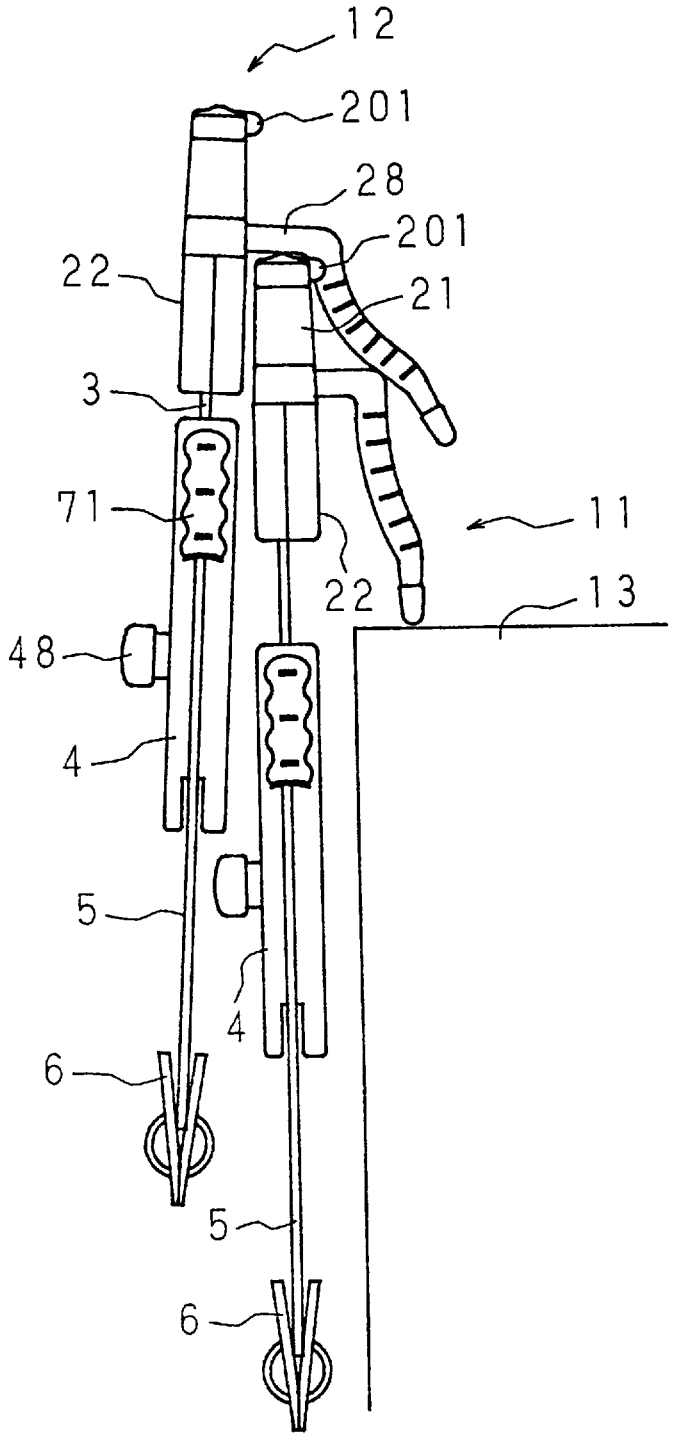
FIG. 17 is a side view for illustrating usage of the hanger of the second embodiment.
Figure 18:
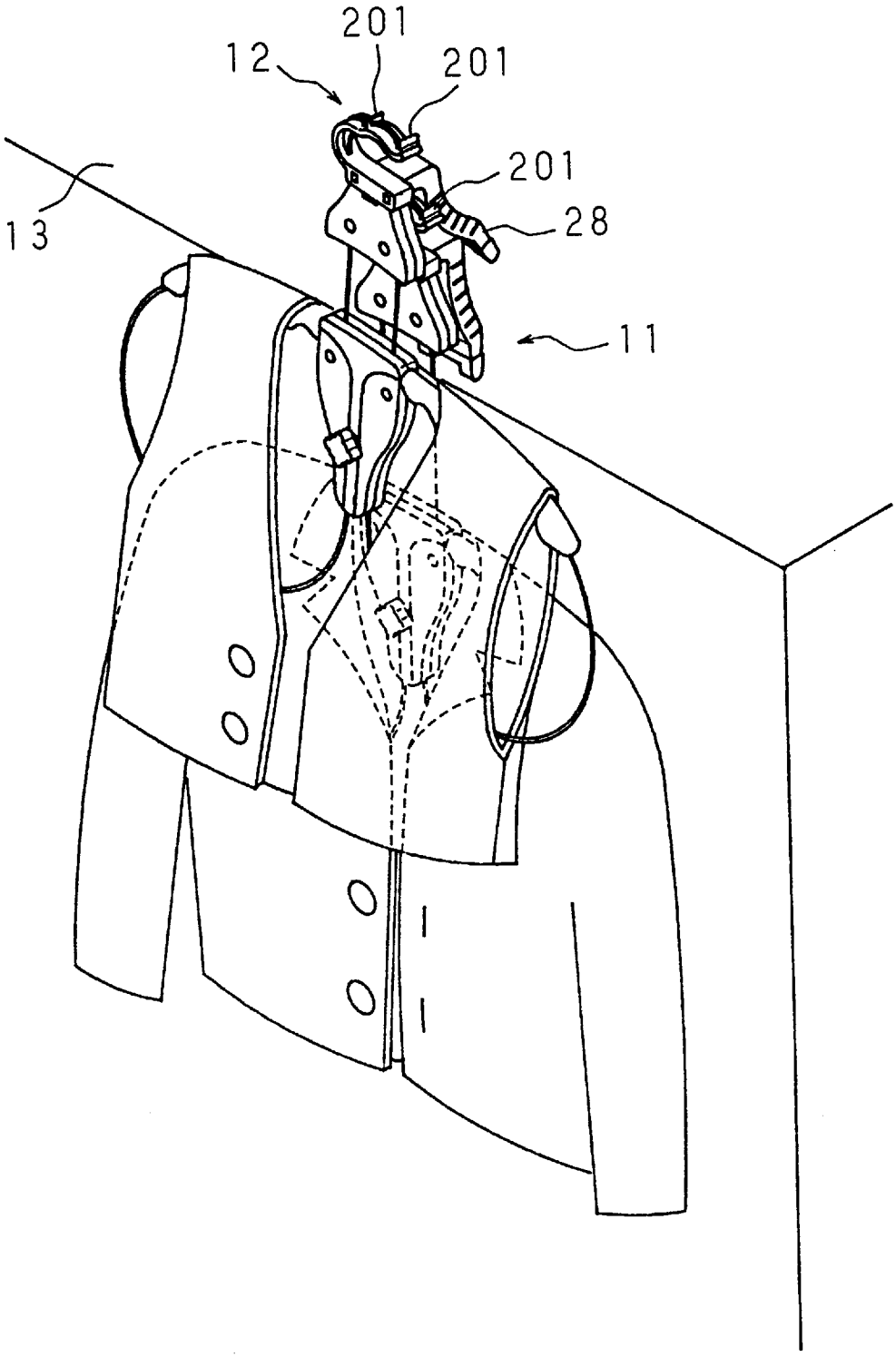
FIG. 18 is a perspective view for illustrating the usage of the hanger of the second embodiment.

The hanger of this embodiment can be used in the same manner as the hanger of the first embodiment, and can attain the same effects. Moreover, when this hanger is used in the following manner, a further effect can be attained: FIG. 17 is a side view for illustrating usage of the hanger of the second embodiment, and FIG. 18 is a perspective view of the hanger in use, namely, suspending a garment. A first hanger 11 is placed on a table 13 with the legs 28*b* of the catching part 28 in contact with the top face of the table 13. The catching part 28 of a second hanger 12 is caught on the top face of the clipping part 21 of the first hanger 11, with the clipping part 21 of the first hanger 11 sandwiched between the clipping part 28 and the fixing case 22 of the second hanger 12. At this point, the base portion of the catching part 28 of the second hanger 12 is fit and fixed between the fixing ribs 201 of the first hanger 11.

In this manner, plural hangers can be linked with one another in the vertical direction. As a result, when a narrow space for placing the first hanger is available, other hangers can be successively placed on the first hanger. As is shown in FIG. 18, by suspending garments on these hangers, a plurality of garments can be suspended in a small space. Moreover, when no garment is suspended on the hangers as is shown in FIG. 17, the hangers can be conveniently stored without getting tangled with one another.

In the second embodiment, two hangers are linked with each other, but the number of the hangers is not limited to two. The hangers can be linked with one another in any number according to the weights of garments to be hung.

Furthermore, the hanger of the first embodiment can be used to be linked with another hanger similarly to the hanger of the second embodiment. In this case, the clipping part of a first hanger is inserted into a space between the fixing case and the catching part of a second hanger, so that the catching part of the second hanger can be supported by the top face of the clipping part of the first hanger.

In the first and second embodiments, the wires are used as the flexible material for the loops, which does not limit the invention. It is possible to adopt any material which has flexibility sufficient for smoothly elongating or shortening the loops 5 in accordance with the length change of the neck part 3 and has a strength sufficient for withstanding the weight of a garment to be hung. Furthermore, in these embodiments, the supporting case 4, the fixing case 22, the clipping part 21 and the catching part 28 are made of the synthetic resins, which does not limit the invention. It is possible to adopt any material which is sufficiently light for use by a child and is sufficiently strong for retaining a suspended garment.

In this manner, one end of a flexible material forming a loop for suspending an object to be hung is linked with a suspending part in the hanger of this invention. Accordingly, when the suspending part is moved away from a supporting part, the dimension of the loop is decreased, so that the latitudinal length of shoulders of the hanger can be adjusted in accordance with the size of a garment to be hung. Moreover, when the dimension of the loop is decreased, the neck part is elongated conveniently for suspending the hanger at a high position. Also, since a screw member presses a loop extension through a case serving as the supporting part, the loop can be easily locked and unlocked for the adjustment of the dimension thereof. Furthermore, by providing the loop with a hanger assisting member, the object to be hung can be stably suspended. Moreover, since a catching part which can be freely bent in the back-and-forth direction is provided, the hanger can be suspended on a variety of places. In addition, by forming ribs on the suspending part, a plurality of hangers can be stably linked with one another in the vertical direction.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

I claim:

1. A hanger comprising:

a hanger part formed of two loops of flexible material, each having a first and second end, for suspending an object to be hung;

a supporting part through which extends an end extension of variable length of each of said loops, each extension including the first end of the respective loop said supporting part being movable relative to said end extensions, each of said second ends being fixed thereto; and a suspending part to which the first end of each of said loops is fixedly connected at a variable distance from said supporting part, substantially the entirety of each loop between the end extension and second end being flexible, the dimensions of said loops being changed by varying the length of said loop extending parts between said supporting part and said suspending part.

2. The hanger according to claim 1, wherein the supporting part includes:

a first fixing part for fixing one end of the flexible material; and a presser part for locking movement of the loop extensions by applying a pressure to the loop extensions, and the suspending part includes a second fixing part for fixing the other end of the flexible material.

3. The hanger according to claim 1, wherein the supporting part includes:

a case separable in the back-and-forth direction for housing the loop extensions; and a screw member for fixing the case, and the loop extensions are pressed through the case by screwing the screw member.

4. The hanger according to claim 1, wherein the two loop extensions cross each other in the supporting part.

5. The hanger according to claim 1, wherein the flexible material is a wire, and each of the loops is provided with a hanger assisting member which has a width larger than a diameter of the wire and a length along the loop, at a portion for supporting the object to be hung.

6. The hanger according to claim 1, wherein the suspending part includes a catching part projecting from a rear face of the suspending part in a reverse L-shape in a sectional view, the catching part being able to bend in the back-and-forth direction owing to a plurality of hinges provided on a rear face thereof.

7. The hanger according to claim 2, wherein the two loop extensions cross each other in the supporting part.

8. The hanger according to claim 2, wherein the flexible material is a wire, and each of the loops is provided with a hanger assisting member which has a width larger than a diameter of the wire and has a length along the loop, at a portion for supporting the object to be hung.

9. The hanger according to claim 2, wherein the suspending part includes a catching part projecting from a rear face of the suspending part in a reverse L-shape in a sectional view, the catching part being able to bend in the back-and-forth direction owing to a plurality of hinges provided on a rear face thereof.

10. The hanger according to claim 6, wherein the suspending part has a plurality of ribs on a face reverse to a face close to the supporting part, the ribs being aligned in a crosswise direction crossing the back-and-forth direction with a distance substantially equal to a width of the catching part.

11. The hanger according to claim 6, wherein the suspending part has a plurality of ribs on a rear face aligned in a crosswise direction crossing the back-and-forth direction with a distance substantially equal to a width of the catching part.

12. The hanger according to claim 9, wherein the suspending part has a plurality of ribs on a face reverse to a face close to the supporting part, the ribs being aligned in a crosswise direction crossing the back-and-forth direction with a distance substantially equal to a width of the catching part.

13. The hanger according to claim 9, wherein the suspending part has a plurality of ribs on a rear face aligned in a crosswise direction crossing the back-and-forth direction with a distance substantially equal to a width of the catching part.

14. The hanger according to claim 10, wherein the suspending part has a plurality of ribs on a rear face aligned in a crosswise direction crossing the back-and-forth direction with a distance substantially equal to a width of the catching part.

15. The hanger according to claim 12, wherein the suspending part has a plurality of ribs on a rear face aligned in a crosswise direction crossing the back-and-forth direction with a distance substantially equal to a width of the catching part.

* * * * *